US009721511B2

(12) United States Patent
Jeong et al.

(10) Patent No.: US 9,721,511 B2
(45) Date of Patent: Aug. 1, 2017

(54) DISPLAY DEVICE AND CONTROL METHOD THEREOF

(71) Applicant: Samsung Display Co., Ltd., Yongin, Gyeonggi-Do (KR)

(72) Inventors: Ji-Woong Jeong, Yongin (KR); Cheol-Woo Park, Yongin (KR); Eun-Ho Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 82 days.

(21) Appl. No.: 14/217,201

(22) Filed: Mar. 17, 2014

(65) Prior Publication Data

US 2015/0130851 A1 May 14, 2015

(30) Foreign Application Priority Data

Nov. 13, 2013 (KR) ..... 10-2013-0137348

(51) Int. Cl.

| | |
|---|---|
| ***G09G 5/10*** | (2006.01) |
| ***G09G 3/3291*** | (2016.01) |
| ***G09G 3/36*** | (2006.01) |
| ***G09G 3/20*** | (2006.01) |

(52) U.S. Cl.

CPC ..... *G09G 3/3291* (2013.01); *G09G 3/20* (2013.01); *G09G 3/3688* (2013.01); *G09G 2310/0218* (2013.01); *G09G 2310/0291* (2013.01); *G09G 2310/0297* (2013.01); *G09G 2310/04* (2013.01); *G09G 2350/00* (2013.01)

(58) Field of Classification Search

CPC ..... G09G 3/20; G09G 3/2014; G09G 3/3291; G09G 2310/0218; G09G 2310/066; G09G 2320/0223; G09G 2320/0233; G09G 2320/0252; G09G 2320/029; G09G 2320/0295; G09G 2320/04; G09G 2320/0686

USPC ... 345/690, 691, 208, 211, 212, 214, 76, 87, 345/88, 94, 99

See application file for complete search history.

(56) References Cited

U.S. PATENT DOCUMENTS

| | | | | |
|---|---|---|---|---|
| 6,424,328 | B1 * | 7/2002 | Ino | G09G 3/3614 345/100 |
| 6,456,270 | B1 * | 9/2002 | Itakura | G09G 3/3688 345/206 |
| 6,703,994 | B2 * | 3/2004 | Edwards | G09G 3/3648 345/87 |
| 6,914,587 | B2 * | 7/2005 | Kosaka | G09G 3/3688 345/215 |

(Continued)

FOREIGN PATENT DOCUMENTS

| | | |
|---|---|---|
| KR | 10-2007-0070818 A | 7/2007 |
| KR | 10-2008-0111497 | 12/2008 |
| KR | 10-2012-0120517 A | 11/2012 |

*Primary Examiner* — Jason Mandeville

(74) *Attorney, Agent, or Firm* — Lewis Roca Rothgerber Christie LLP

(57) ABSTRACT

A display device includes: a display unit including a plurality of pixels and a plurality of division areas; a data driver configured to apply a data signal corresponding to image data to the display unit, and to control a slew rate of the data signal, based on a bias voltage; and a bias controller configured to control the data driver so that the slew rate of the data signal is changed for each division area, based on a luminance variation of the image data corresponding to each of the division areas.

16 Claims, 3 Drawing Sheets

(56) References Cited

U.S. PATENT DOCUMENTS

| | | | | |
|---|---|---|---|---|
| 7,317,440 | B2 * | 1/2008 | Chung | 345/89 |
| 7,750,898 | B2 * | 7/2010 | Welbers | G09G 3/3688 345/100 |
| 2007/0222519 | A1 | 9/2007 | Deng et al. | |
| 2008/0266276 | A1 * | 10/2008 | Choi et al. | 345/204 |
| 2008/0278473 | A1 * | 11/2008 | An | H04L 25/028 345/214 |
| 2011/0205204 | A1 * | 8/2011 | Park | 345/211 |
| 2012/0026152 | A1 * | 2/2012 | Chung | 345/212 |
| 2012/0120040 | A1 * | 5/2012 | Ogawa | G09G 3/3688 345/208 |
| 2013/0113848 | A1 * | 5/2013 | Bae et al. | 345/691 |
| 2013/0307838 | A1 * | 11/2013 | Kim | G09G 5/001 345/212 |

* cited by examiner

DISPLAY DEVICE AND CONTROL METHOD THEREOF

CROSS-REFERENCE TO RELATED APPLICATION

This application claims priority to and the benefit of Korean Patent Application No. 10-2013-0137348, filed on Nov. 13, 2013, in the Korean Intellectual Property Office, the entire contents of which are incorporated herein by reference in their entirety.

BACKGROUND

1. Field

An aspect of embodiments of the present invention relates to a display device and a control method thereof.

2. Description of the Related Art

Among display devices, flat panel displays having relatively high image-display quality, light weight, thin profile, and low power consumption characteristics are frequently used. These display devices include, for example, liquid crystal displays, organic light emitting displays, and the like.

A display device may include a display unit including a plurality of pixels arranged in a matrix form, a scan driver configured to supply a scan signal, a data driver configured to supply a data signal, and the like.

The data driver converts a digital data signal into an analog data signal whenever a scan signal is supplied, and supplies the converted analog data signal to data lines of the display unit. In the data driver, the amount of output current is large, and the swing width of an output signal is also large. Accordingly, the data driver may consume a large proportion of power within the display device.

SUMMARY

According to an aspect of embodiments of the present invention, a display device includes: a display unit including a plurality of pixels and a plurality of division areas; a data driver configured to apply a data signal corresponding to image data to the display unit, and to control a slew rate of the data signal, based on a bias voltage; and a bias controller configured to control the data driver so that the slew rate of the data signal is changed for each division area, based on a luminance variation of the image data corresponding to each of the division areas.

The bias controller may be configured to control the data driver to apply the bias voltage when the luminance variation of the image data is greater than a reference value and to block the bias voltage when the luminance variation of the image data is smaller than the reference value.

The bias controller may be configured to control the data driver to increase a level of the bias voltage as the luminance variation of the image data increases.

The bias controller may include a data analysis unit configured to calculate the luminance variation of the image data by comparing gray levels of the image data on an N-th line and the image data on an (N+1)-th line in one frame.

The luminance variation may be obtained by adding difference values between the gray levels of the image data on the N-th line and the image data on the (N+1)-th line.

The level of the bias voltage may become a maximum value when an addition value is the maximum value, and may become a minimum value when the addition value is the minimum value.

The luminance value may be a maximum value among difference values between the gray levels of the image data on the N-th line and the image data on the (N+1)-th line.

The bias controller may include a control signal output unit configured to output a bias control signal for controlling a level of the bias voltage for each division area, based on the luminance variation.

The data driver may include a plurality of buffer units respectively corresponding to the division areas.

The respective buffer units may be configured to receive different bias voltages based on the luminance variation of the image data.

The data driver may include a bias voltage changing unit configured to change a level of the different bias voltages, in response to the bias control signal.

The bias voltage may have a same period as a horizontal synchronization signal of the image data.

The bias voltage may be applied by avoiding a transient section of the data signal.

Each buffer unit may include a plurality of output buffers respectively coupled to data lines for transmitting the data signal.

The output buffers may include an operational amplifier.

The division areas may be divided as a unit of lines parallel to the data lines for transmitting the data signal.

According to an aspect of the present invention, a method of controlling a display device includes: the display device including: a display unit including a plurality of pixels, the display unit including a plurality of division areas; and a data driver configured to apply a data signal corresponding to an image data to the display unit, and to control a slew rate of the data signal, based on a bias voltage, the method including: calculating a luminance variation of image data corresponding to each of the division areas; and controlling the data driver such that the slew rate of the data signal is changed for each division area, based on the luminance variation.

BRIEF DESCRIPTION OF THE DRAWINGS

Example embodiments will now be described more fully hereinafter with reference to the accompanying drawings; however, the present invention may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
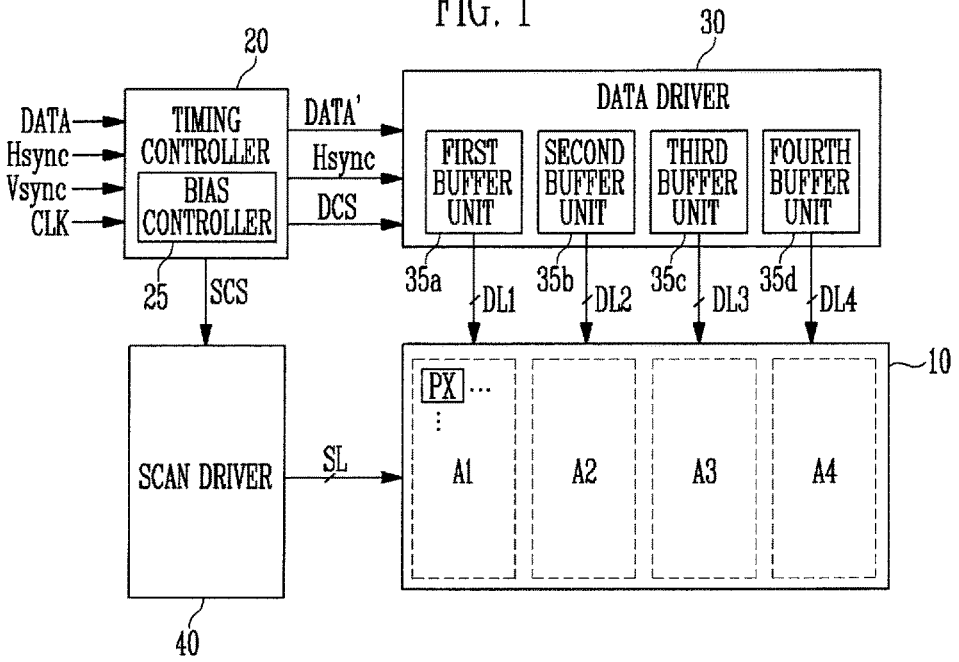
FIG. 1 is a schematic configuration diagram illustrating a display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a schematic configuration diagram illustrating a display device according to an embodiment of the present invention.

Referring to FIG. 1, the display device may include a display unit 10, a timing controller 20, a data driver 30 and a scan driver 40.

The display unit 10 includes a plurality of pixels PX coupled to a plurality of scan lines SL formed in a first direction to supply a scan signal and a plurality of data lines DL1 to DL4 formed in a second direction intersecting to the first direction to supply a data signal. The plurality of pixels PX are arranged in a matrix form. In one embodiment, each pixel PX may include an organic light emitting diode OLED, which emits light with luminance corresponding to the data signal by receiving a power source supplied from an outside, and switching elements which control the flow of driving current.

The display unit 10 is divided into a plurality of division areas A1 to A4 to calculate a luminance variation of an image data for each area. The division areas A1 to A4 may be divided as a unit of lines parallel to the data lines DL1 to DL4. Here, the data lines DL1 to DL4 may be grouped corresponding to the division areas A1 to A4. In one embodiment, the first data lines DL1 supply a data signal to pixels PX belonging to a first division area A1, the second data lines DL2 supply a data signal to pixels PX belonging to a second division area A2, the third data lines DL3 supply a data signal to pixels PX belonging to a third division area A3, and the fourth data lines DL4 supply a data signal to pixels PX belonging to a fourth division area A4.

In one embodiment, the first to fourth division areas A1 to A4 are obtained by vertically dividing the display unit 10 are described as an example, but the shape, number and size of the division areas A1 to A4 may be variously modified. As the display unit is divided into a larger number of division areas having a smaller size, it may be possible to more efficiently control the data driver 30 and to reduce power consumption.

The timing controller 20 receives, from an external image source, image data DATA and input control signals for controlling display of the image data DATA (e.g., a horizontal synchronization signal Hsync, a vertical synchronization signal Vsync, a clock signal CLK and the like). The timing controller 20 generates an image data DATA' corrected suitable for image display of the display unit 10, and provides the generated image data DATA' to the data driver 30. The timing controller 20 generates and outputs driving control signals DCS and SCS for controlling driving of the data driver 30 and the scan driver 40, based on the input control signals.

The data driver 30 is coupled to the plurality of data lines DL1 to DL4. The data driver 30 generates a data signal, in response to a data control signal DCS of the timing controller 20, and outputs the generated data signal to the data lines DL1 to DL4. In this case, the data driver 30 converts the digital image data DATA' provided from the timing controller 20 into an analog data signal, and outputs the converted analog data signal to the data lines DL1 to DL4. The analog data signal is generated based on a gamma reference voltage, and the data driver 30 may receive the gamma reference voltage supplied from a gamma reference voltage generation unit (not shown). The data driver 30 sequentially supplies a data signal to each pixel included in a row (e.g., a predetermined row) among the pixels PX of the display unit 10.

The data driver 30 includes a plurality of buffer units 35*a* to 35*d* respectively corresponding to the division areas A1 to A4 of the display unit 10. The buffer units 35*a* to 35*d* function to stabilize the power of the data signal. Each buffer unit 35*a* to 35*d* outputs a data signal to the display unit 10 through a corresponding data line DL1 to DL4. In this embodiment, a first buffer unit 35*a* outputs a data signal to pixels PX of the first division area A1 through the first data lines DL1, a second buffer unit 35*b* outputs a data signal to pixels PX of the second division area A2 through the second data lines DL2, a third buffer unit 35*c* outputs a data signal to pixels PX of the third division area A3 through the third data lines DL3, and a fourth buffer unit 35*d* outputs a data signal to pixels PX of the fourth division area A4 through the fourth data lines DL4.

In the first to fourth buffer units 35*a* to 35*d*, the slew rate of the data signal is controlled based on a bias voltage. The slew rate is defined as a rate of rising time with respect to change in output voltage. The slew rate of the data signal is controlled by changing the bias voltage supplied to the buffer units 35*a* to 35*d*. In this embodiment, bias voltages are independently applied to the respective first to fourth buffer units 35*a* to 35*d*, in response to the data control signal DCS of the timing controller 20, and therefore, the slew rates of data signals output from the respective buffer units 35*a* to 35*d* may be different from one another. The driving of the data driver 30 will be described in detail with reference to FIGS. 2 and 3.

The scan driver 40 is coupled to the plurality of scan lines SL. The scan driver 40 generates a scan signal, in response to a scan control signal SCS, and outputs the generated scan signal to the scan lines SL. Pixels PX for each row are sequentially selected, in response to the scan signal, so that the data signal can be supplied to the selected pixels PX. The scan driver 40 may supply a scan signal according to a defined scan frequency (e.g., a predetermined scan frequency), and the scan frequency may be controlled by the timing controller 20.

Meanwhile, the timing controller 20 may include a bias controller 25 configured to control the data driver 30 so that the slew rate of the data signal is changed for each division area A1 to A4. The bias controller 25 previously determines the level of a bias voltage to be applied to each buffer unit 35*a* to 35*d* according to a luminance variation of the image data DATA', corresponding to each division area A1 to A4.

Specifically, the bias controller 25 may control the data driver 30 to apply the bias voltage when the luminance variation of the image data DATA' is greater than a reference value and to block the bias voltage when the luminance variation of the image data DATA' is smaller than the reference value. Here, the luminance variation is calculated based on a gray level value of the image data DATA'. Because the data signal is applied as a unit of horizontal lines parallel to the scan lines, the data signal may be calculated by comparing gray level values of the image data DATA' between horizontal lines.

When a bias voltage is applied, the bias controller 25 may increase the level of the bias voltage as the luminance variation of the image data DATA' increases. That is, if the luminance variation is greater than the reference value, the bias controller 25 may apply the bias voltage by changing the level of the bias voltage in proportion to the luminance variation. That the luminance variation is great means that the slew rate of the data signal is large. An output buffer of the data driver 30 necessarily achieves a higher increase in the power of the data signal in one horizontal time (1H time), and therefore, the bias voltage applied to the output buffer is necessarily increased. However, the bias voltage is necessarily applied at an appropriate level according to the luminance variation so as to prevent or reduce unnecessary power consumption. To this end, the bias controller 25 may determine a bias voltage at an appropriate level according to the calculated luminance variation, using a predetermined numerical formula, histogram, lookup table, etc.

Figure 2:
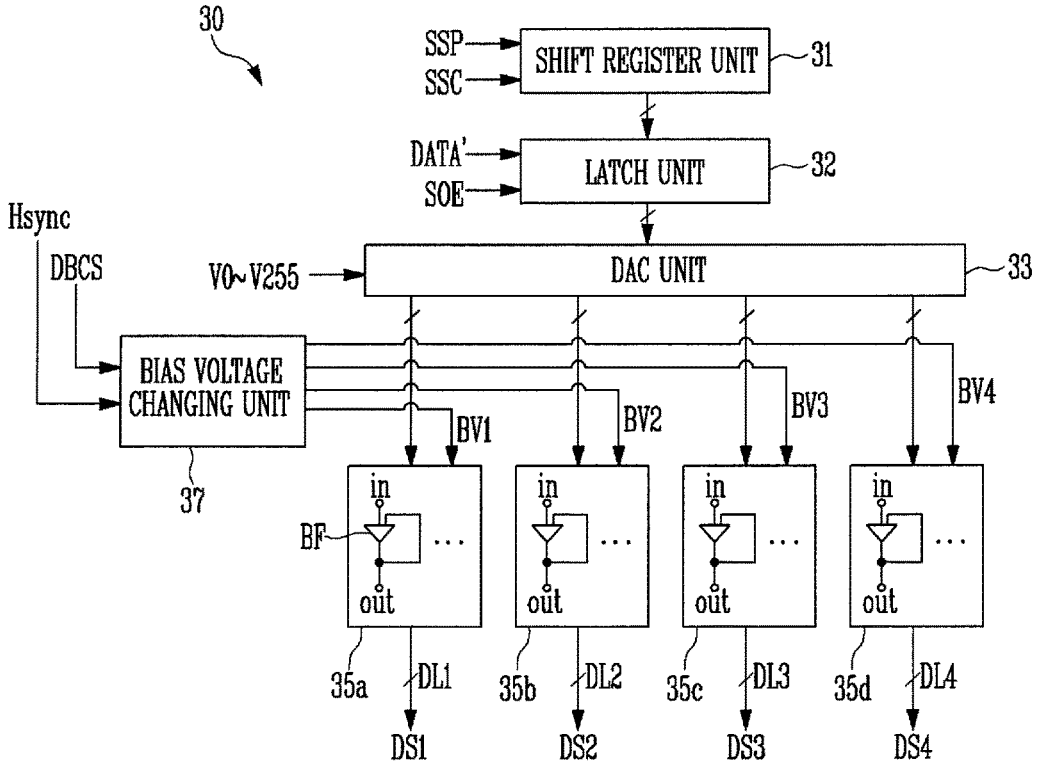
FIG. 2 is a configuration diagram illustrating an embodiment of the data driver shown in FIG. 1.

FIG. 2 is a configuration diagram illustrating an embodiment of the data driver shown in FIG. 1.

Referring to FIG. 2, the data driver 30 may include a shift register unit 31, a latch unit 32, a digital-analog converter unit (DAC unit) 33, buffer units 35*a* to 35*d*, and a bias voltage changing unit 37.

The data driver 30 may receive an image data DATA', a horizontal synchronization signal Hsync and a data control signal DCS, supplied from the timing controller 20. Here, the data control signal DCS may include a source start pulse SSP, a source shift clock SSC, a source output enable SOE, and a bias control signal DBCS.

The shift register unit 31 sequentially generates a sampling signal while shifting the source start pulse SSP supplied from the timing controller 20 according to the source shift clock SSC in one horizontal time. To this end, the shift register unit 121 may include a plurality of shift registers (not shown).

The latch unit 32 may include a first latch unit (not shown) configured to sequentially latch the image data DATA' supplied from the timing controller 20, in response to the sampling signal provided from the shift register 31, and a second latch unit (not shown) configured to latch in parallel a data for one horizontal line, latched in the first latch unit, at a rising time of the source output enable SOE, and supply the latched data to the DAC unit 33.

If an image data DATA' is input from the latch unit 32, the DAC unit 33 generates an analog data corresponding to the digital image data DATA' and output the generated analog voltage to the buffer units 35*a* to 35*d*. In this case, the DAC unit 33 receives gray level voltages V0 to V255 supplied from a gray level voltage generation unit (not shown), to generate a plurality of data voltages, corresponding to the image data DATA'. To this end, the DAC unit 33 may include a plurality of digital-analog converters (DACs).

The buffer units 35*a* to 35*d* supply a plurality of data voltages supplied from the DAC unit 33 to the respective data lines DL1 to DL4. The buffer units 35*a* to 35*d* are divided corresponding to the respective division areas A1 to A4 of the display unit 10, and the data lines DL1 to DL4 and data signals DS1 to DS4 transmitted through the data lines DL1 to DL4 may also be grouped corresponding to the respective division areas A1 to A4. The first buffer unit 35*a* supplies a first data signal DS1 through the first data lines DL1, the second buffer unit 35*b* supplies a second data signal DS2 through the second data lines DL2, the third buffer unit 35*c* supplies a third data signal DS3 through the third data lines DL3, and the fourth buffer unit 35*d* supplies a fourth data signal DS4 through the fourth data lines DL4.

Each buffer unit 35*a* to 35*d* includes a plurality of output buffers BF. The output buffer BF may be configured with an operational amplifier. Specifically, a data voltage provided from the DAC unit 33 is supplied to a non-inverting terminal of the output buffer BF, and an output voltage is fed back to an inverting terminal of the output buffer BF. The output buffers BF correspond to the data lines one by one, and each output buffer BF supplies, to the data line coupled to an output terminal thereof, the output voltage output according to the data voltage input to the non-inverting terminal. In this case, the output buffer BF controls output voltages (e.g., the slew rates) of data signals DS1 to DS4, based on bias voltages BV1 to BV4 provided from the bias voltage changing unit 37. In one embodiment, the slew rate of the first data signal DS1 is controlled based on a first bias voltage BV1 applied to the first buffer unit 35*a*, the slew rate of the second data signal DS2 is controlled based on a second bias voltage BV2 applied to the second buffer unit 35*b*, the slew rate of the third data signal DS3 is controlled based on a third bias voltage BV3 applied to the third buffer unit 35*c*, and the slew rate of the fourth data signal DS4 is controlled based on a fourth bias voltage BV4 applied to the fourth buffer unit 35*d*.

The bias voltage changing unit 37 changes the voltage levels of the bias voltages BV1 to BV4, in response to the bias control signal DBCS. The bias voltage changing unit 37 may control the voltage level of each bias voltage BV1 to BV4, in response to the bias control signal DBCS. Each buffer units 35*a* to 35*d* receiving the controlled bias voltage BV1 to BV4 controls bias current and thus can change the slew rate of the data signal DS1 to DS4 for each division area A1 to A4.

However, the data driver 30 is not limited to the structure described above, and may be modified into various structures in which the slew rate of the data signal can be controlled based on the bias voltage.

Figure 3:
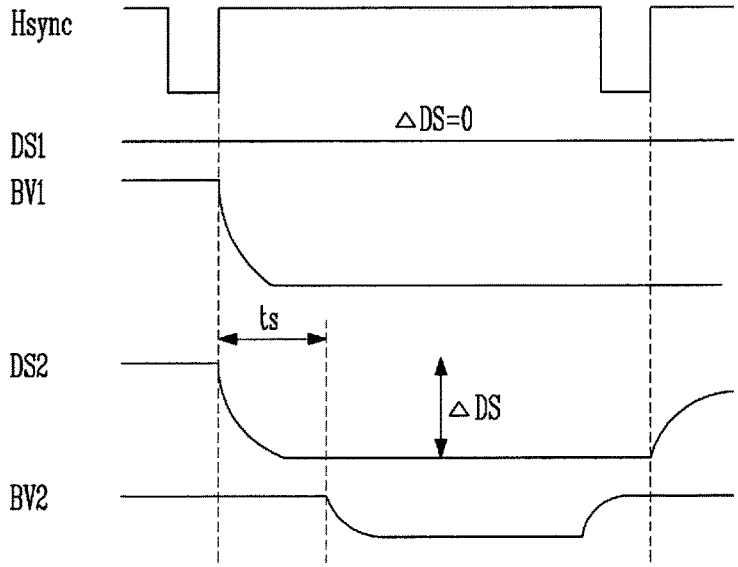
FIG. 3 is a waveform diagram illustrating a control method of a bias voltage.

FIG. 3 is a waveform diagram illustrating a control method of a bias voltage.

Referring to FIG. 3, the slew rate of the data signal DS1 to DS4 shows a slope degree having a waveform which rises (or drops) up to maximum value. The slew rates of the data signals DS1 to DS4 are controlled by respectively changing the bias voltages BV1 to BV4 supplied to the buffer units 35*a* to 35*d*. The bias voltages BV1 to BV4 respectively determines amplification ratios of the output buffers BF included in the buffer units 35*a* to 35*d*. Specifically, if the bias voltages BV1 to BV4 increase, the slew rates of the data signals DS1 to DS4. If the bias voltages BV1 to BV4 decreases, the slew rates of the data signals DS1 to DS4 decrease.

The buffer unit 35*a* to 35*d*, the bias voltages applied to the respective buffer units 35*a* to 35*d*, and the data signals DS1 to DS4 output from the respective buffer units 35*a* to 35*d* are components or signals corresponding to the respective division areas A1 to A4. The bias voltages BV1 to BV4 applied to the respective buffer units 35*a* to 35*d* may be different from one another depending on a luminance variation of the image data DATA' which becomes a source of the data signals DS1 to DS4.

For example, a specific image may be positioned in a middle area, based on a background of a single color in an image of one frame. Here, the background corresponds to the first division area A1, and the specific image is positioned in the second division area A2. In this case, the variation range ΔDS of the first data signal DS1 output in the first division area A1 will be slight or have a value of 0. Such a fact may be previously predicted by analyzing an image data DATA' corresponding to the first division area A1 and calculating a luminance variation before the image data DATA' for generating the first data signal DS1 is input to the data driver 30. Since the calculated luminance variation has a value of 0 (or is smaller than the reference value), the bias controller 25 controls the data driver 30 to block the first bias voltage BV1. Thus, the first bias voltage BV1 has a low value in a section where the variation range ΔDS of the first data signal DS1 is 0.

Meanwhile, the variation range ΔDS of the second data signal DS2 output in the second division area A2 where the specific image is positioned will be large. Such a fact may be previously predicted by analyzing an image data DATA' corresponding to the second division area A2 and calculating a luminance variation. Because the calculated luminance variation has a value greater than the reference value, the bias controller 25 controls the data driver 30 to apply the second bias voltage BV2. Thus, the second bias voltage BV2 has a high value in a section where the variation range ΔDS of the second data signal DS2 is large.

Because the data signal DS1 to DS4 is applied for each line according to the scan signal, the bias voltage BV1 to BV4 may be output with the same period as the horizontal synchronization signal Hsync. However, the bias voltage BV1 to BV4 is applied by avoiding a transient section is where the data signal DS1 to DS4 is rapidly changed.

Figure 4:
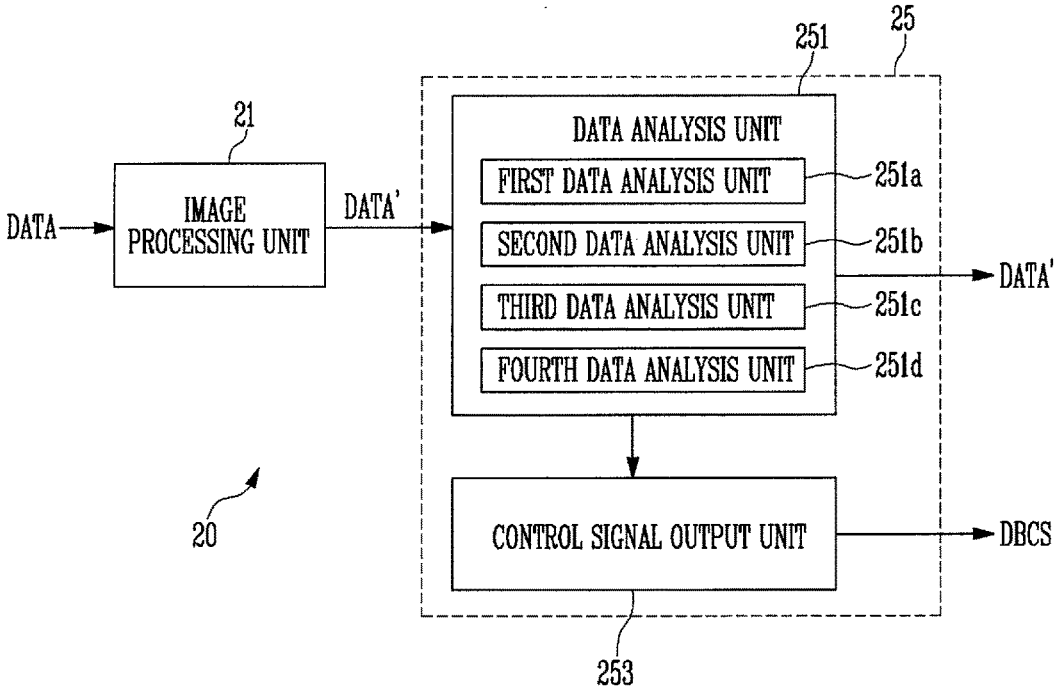
FIG. 4 is a configuration diagram illustrating an embodiment of the bias controller shown in FIG. 1.
Figure 5:
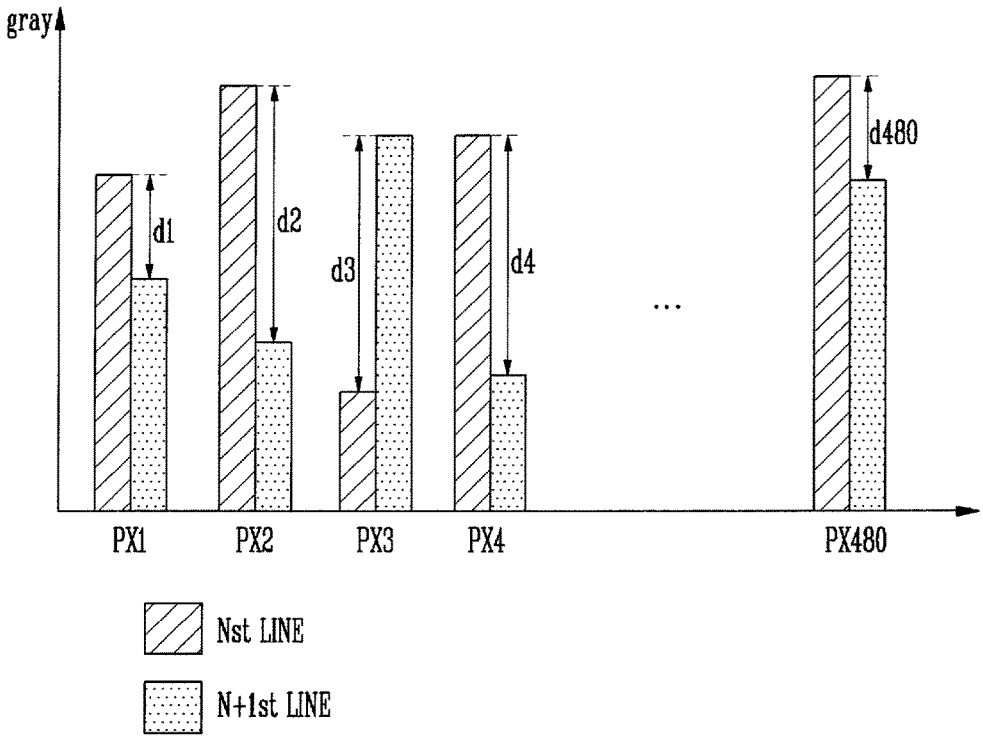
FIG. 5 is a diagram illustrating a method of calculating a luminance variation of image data.

FIG. 4 is a configuration diagram illustrating an embodiment of the bias controller shown in FIG. 1. FIG. 5 is a diagram illustrating a method of calculating a luminance variation of an image data.

Referring to FIGS. 4 and 5, the bias controller 25 may include a data analysis unit 251 configured to calculate a luminance variation by analyzing an image data DATA', and a control signal output unit 253 configured to output a bias control signal DBCS for controlling the level of the bias voltage BV1 to BV4 for each division area A1 to A4 according to the calculated luminance variation.

The data analysis unit 251 receives an image data DATA' corrected suitable for image display of the display unit 10 from an image processing unit 21. The data analysis unit 251 calculates a luminance variation of the image data DATA' by comparing gray level values of an image data on an N-th line and an image data on an (N+1)-th line in one frame. Because the data signal is applied for horizontal line according to the scan line, the data analysis unit 251 may calculate the luminance variation of the image data DATA' by comparing gray level values of the N-th line, i.e., an image data on a previous line and the (N+1)-th line, i.e., an image data on a next line among the image data DATA' sequentially input as a unit of lines.

However, because the luminance variation is calculated with respect to each division area A1 to A4, the data analysis unit 251 may be divided into first to fourth data analysis units 251*a* to 251*d* respectively corresponding to the first to fourth division areas A1 to A4. For example, if the resolution of the display unit 10 is 1920×1080, one horizontal line is configured with 1920 pixels, and the number of pixels included in horizontal lines of each division area A1 to A4 will be 480. The first to fourth data analysis units 251*a* to 251*d* have the same luminance variation calculating method, and therefore, a luminance variation calculating method of the first data analysis unit 251*a* will be described below.

In an embodiment, the luminance value may be determined as the value obtained by adding difference values d1 to d480 between gray levels of an image data on an N-th line and an image data on an (N+1)-th line. First, the difference values d1 to d480 between the gray levels of the image data on the N-th line and the image data on the (N+1)-th line are obtained with respect to each pixel PX1 to PX480 on one horizontal line. Here, the pixels PX1 to PX480 are pixels belonging to the first division area A1. In a case where the addition value is the maximum value, the level of the first bias voltage BV1 corresponding to the first division area A1 becomes the maximum value. In a case where the addition value is the minimum value, the level of the second bias voltage BV2 becomes the minimum value. In the luminance variation calculating method, the bias voltage is substantially determined based on the average value of a pixel variation in a corresponding area. The luminance variation calculating method has a characteristic in that the charging/discharging rate of the data driver 30 may be relatively lowered, but the effect that reduces power consumption can be relatively improved.

In another embodiment, the luminance variation may be determined as the maximum value among the difference values d1 to d480 between the gray levels of the image data on the N-th line and the image data on the (N+1)-th line. That is, the bias voltage is determined based on a value having the greatest luminance variation of the image data. The luminance variation calculating method has a characteristic in that the power consumption of the data driver 30 may be relatively increased. However, the operational logic is relatively simplified, and the charging/discharging rate may be relatively increased.

The control signal output unit 253 sets the bias control signal DBCS so that the slew rate of a data signal is changed as a unit of horizontal lines, using a gate start pulse having one frame period. The charging/discharging time of the data signal is taken for a long period of time as the luminance variation is relatively increased, and therefore, a high slew rate is required so that the data signal approaches a target voltage within a limited time. Accordingly, the control signal output unit 253 sets the bias control signal DBCS so that the slew rate of the data signal is relatively increased in proportion to the luminance variation of the data signal.

By way of summation and review, as the resolution of a display device increases, the power consumption of a data driver may be increased. Specifically, as the resolution of the display device increases, an output buffer of the data driver necessarily allows a data signal to be charged/discharged within a short period of time, and the slew rate of output buffers is necessarily increased. If the slew rate is increased, the static power of the output buffer is increased.

According to the present invention, the power consumption of the data driver and the display device including the same can be reduced by controlling the data driver so that the slew rate of a data signal is changed for each division area, based on the luminance variation of an image data.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A display device, comprising:

a display unit comprising a plurality of pixels arranged in rows and columns;

a bias controller configured to receive image data corresponding to the plurality of pixels and to process the image data according to a plurality of predefined division areas of the display unit, each of the division areas corresponding to a plurality of adjacent columns of the plurality of the pixels;

a data driver receiving processed image data from the bias controller, the data driver comprising a plurality of buffer units each buffer unit coupled to a corresponding one of the division areas, each of the buffer units comprising a plurality of output buffers each output buffer respectively corresponding to one of the adjacent columns of the plurality of the pixels in the corresponding one of the division areas, the buffer units being configured to apply data signals corresponding to the processed image data respectively to the corresponding one of the division areas of the display unit, and to control a slew rate of the data signals in the corresponding one of the division areas based on a bias voltage from among a plurality of bias voltages generated within the data driver to control the plurality of output buffers, wherein each of the plurality of bias voltages is respectively generated for and applied to a corresponding buffer unit from among the plurality of buffer units such that each of the plurality of output buffers within a same buffer unit receives a same bias voltage, specific for the corresponding division area coupled to the same buffer unit, that is independent of bias voltages received by the plurality of output buffers in adjacent buffer units and such that each of the data signals applied to a same division area has a same slew rate that is independent of slew rates of data signals applied to adjacent division areas; and wherein the bias controller is configured to provide a bias control signal to control the data driver so that the slew rate of the data signals corresponding to a respective row of pixels is determined for each division area separately, based on an analysis of luminance variation of the image data in adjacent rows of pixels in a corresponding division area from a data analysis unit within the bias controller.

2. The display device of claim 1, wherein the bias controller is configured to control the data driver to apply a bias voltage from among the plurality of bias voltages when the luminance variation of the image data in a corresponding division area is greater than a reference value and to block the bias voltage from among the plurality of bias voltages when the luminance variation of the image data in the corresponding division area is smaller than the reference value.

3. The display device of claim 2, wherein the bias controller is configured to control the data driver to increase a level of a bias voltage from among the plurality of bias voltages as the luminance variation of the image data in a corresponding division area increases.

4. The display device of claim 3, wherein the data analysis unit is configured to calculate a luminance variation of the image data by comparing gray levels of the image data on an N-th line and the image data on an (N+1)-th line in one frame in a corresponding division area.

5. The display device of claim 4, wherein the luminance variation is obtained by adding difference values between the gray levels of the image data on the N-th line and the image data on the (N+1)-th line in a corresponding division area.

6. The display device of claim 5, wherein the level of the bias voltage in a corresponding division area becomes a maximum value when an addition value is the maximum value, and becomes a minimum value when the addition value is the minimum value.

7. The display device of claim 4, wherein the luminance variation is determined as a maximum value among difference values between the gray levels of the image data on the N-th line and the image data on the (N+1)-th line in a corresponding division area.

8. The display device of claim 3, wherein the bias controller comprises a control signal output unit configured to output the bias control signal for controlling a level of the bias voltage for each division area, based on the luminance variation in a corresponding division area.

9. The display device of claim 8, wherein the buffer units are configured to receive different bias voltages based on the luminance variation of the image data in a corresponding division area.

10. The display device of claim 9, wherein the data driver comprises a bias voltage changing unit configured to change a level of the different bias voltages, in response to the bias control signal.

11. The display device of claim 10, wherein the different bias voltages have a same period as a horizontal synchronization signal of the image data.

12. The display device of claim 11, wherein the different bias voltages are applied by avoiding a transient section of the data signals.

13. The display device of claim 1, wherein each of the plurality of output buffers is respectively coupled to a data line for transmitting the respective data signals.

14. The display device of claim 13, wherein each of the plurality of output buffers comprises an operational amplifier.

15. The display device of claim 14, wherein the division areas are divided as a unit of columns of pixels parallel to the data lines for transmitting the data signals.

16. A method of controlling a display device, the display device comprising:

a display unit comprising a plurality of pixels arranged in rows and columns, a bias controller configured to receive image data corresponding to the plurality of pixels and to process the image data according to a plurality of predefined division areas of the display unit, each of the division areas corresponding to a plurality of adjacent columns of the plurality of the pixels; and a data driver receiving processed image data from the bias controller, the data driver comprising a plurality of buffer units each buffer unit coupled to a corresponding one of the division areas, each of the buffer units comprising a plurality of output buffers each output buffer respectively corresponding to one of the adjacent columns of the plurality of the pixels in the corresponding one of the division areas, the buffer units being configured to apply data signals corresponding to the processed image data respectively to the corresponding one of the division areas of the display unit, and to control a slew rate of the data signals in the corresponding one of the division areas based on a bias voltage from among a plurality of bias voltages generated within the data driver to control the plurality of output buffers, wherein each of the plurality of bias voltages is respectively generated for and applied to a corresponding buffer unit from among the plurality of buffer units such that each of the plurality of output buffers within a same buffer unit receives a same bias voltage, specific for the corresponding division area coupled to the same buffer unit, that is independent of bias voltages received by the plurality of output buffers in adjacent buffer units and such that each of the data signals applied to a same division area has a same slew rate that is independent of slew rates of data signals applied to adjacent division areas; and the method comprising:

calculating a luminance variation of the image data in adjacent rows of pixels in a corresponding division area based on an analysis from a data analysis unit within the bias controller; and controlling the data driver using a bias control signal from the bias controller such that the slew rate of the data signals corresponding to a respective row of pixels is determined for each division area separately, based on the luminance variation of the image data in the adjacent rows of pixels in the corresponding division area.

* * * * *